US005222933A

United States Patent [19]

Knelson et al.

[11] Patent Number: 5,222,933

[45] Date of Patent: Jun. 29, 1993

[54] CENTRIFUAL DISCHARGE OF CONCENTRATE

[75] Inventors: Benjamin V. Knelson, 20321-86th Avenue, R.R. #11, Langley, British Columbia, Canada, V3A 6Y3; Andre Cauchon, Chibougamau, Canada

[73] Assignee: Benjamin V. Knelson, Langley, Canada

[21] Appl. No.: 869,071

[22] Filed: Mar. 20, 1992

[51] Int. Cl.[5] ..... B04B 11/00

[52] U.S. Cl. ..... 494/29; 210/377; 494/27; 494/67; 494/80

[58] Field of Search ..... 494/27-31, 494/36, 43, 44, 45, 56, 60, 65, 80, 85; 210/360.1, 360.2, 369, 377, 378, 380.1, 381, 382, 781

[56] References Cited

U.S. PATENT DOCUMENTS

| | | | |
|---|---|---|---|
| 1,190,466 | 7/1916 | Schifferle | 494/27 X |
| 1,283,846 | 11/1918 | Mark et al. | 494/60 |
| 1,473,421 | 11/1923 | Eccleston | 494/29 |
| 1,594,501 | 8/1926 | Eccleston | 210/251 X |
| 2,179,807 | 11/1939 | Asmussen | 494/45 X |
| 2,272,675 | 2/1942 | Knudsen | 494/43 X |
| 3,774,840 | 11/1973 | Boatright | 494/27 X |
| 4,361,480 | 11/1982 | Corbus et al. | 494/60 X |
| 4,608,040 | 8/1986 | Knelson | 494/27 |
| 4,776,833 | 10/1988 | Knelson | 494/27 |
| 4,824,431 | 4/1989 | McAlister . | |
| 4,983,156 | 1/1991 | Knelson | 494/80 X |

*Primary Examiner*—Harvey C. Hornsby
*Assistant Examiner*—Charles Cooley
*Attorney, Agent, or Firm*—Adrian D. Battison; Stanley G. Ade; Murray E. Thrift

[57] ABSTRACT

A centrifugal separator of the type comprising a bowl having a base and a peripheral wall surrounding a vertical axis about which the bowl rotates and a jacket having a base plate under the base of the bowl and a sleeve surrounding the peripheral wall includes a central bottom discharge for the concentrate. The bowl is mounted on the shaft with a hub connecting the shaft to the base plate of the jacket. Water is supplied through the shaft and through a pair of ducts passing through the hub and into the area of the base of the bowl. The discharge also extends through the hub through a pair of ducts which diverge from the central discharge opening outwardly and downwardly into a collection chamber. The discharge duct portions through the hub are angularly offset from the water supply duct portions through the hub so that both can be formed in the hub.

4 Claims, 4 Drawing Sheets

CENTRIFUAL DISCHARGE OF CONCENTRATE

BACKGROUND OF THE INVENTION

This invention relates to a centrifugal separator of the type comprising a centrifuge bowl around which is provided a jacket for supply of feed water to the area between the jacket and the bowl for supplying fluidizing water into the bowl and particularly to a discharge arrangement for discharging the collected materials from the bowl after processing of a batch of materials.

A centrifugal separator manufactured in accordance with a design of the present inventor is shown for example in U.S. Pat. No. 4,846,781 issued Jul. 11, 1989. In the design shown in this patent the present inventor has taken careful steps by the design of the bowl and injection of fluidizing water from the jacket into the bowl to maximize the efficiency of separation which occurs within the bowl.

One problem which has arisen in view of the design of this bowl is that of providing effective discharge of the collected material from the grooves in the bowl once a batch of material has been processed and the bowl halted. It will be appreciated that the separator of the type shown is a batch type separator in that a quantity of material is processed and the heavier or higher specific gravity materials are collected between the grooves in the bowl until the grooves are effectively filled with the separated materials. Once this occurs it is necessary to halt the processing and to wash down the material for collection at the base of the bowl.

In the design using a surrounding water jacket for the injection of fluidizing water into the bowl through openings at the base of the groove, it is difficult to provide a discharge opening. This problem arises since the water for the water jacket is supplied through the shaft which supports the bowl for rotation. The shaft is generally attached to a hub which is itself attached to the base of the water jacket and hence there is no room available for the discharge at that point. The discharge of the above design is therefore offset to one side and is located under the lowermost one of the grooves at the peripheral wall of the bowl. This location has however provided difficulties in washing down the material from the bowl in that the material tends to collect on the base and is reluctant to move to the discharge opening.

Another design of separator which uses the water jacket principle is shown in Australian application number 22055/35 of MacNicol which was published in 1936. In this arrangement, the water is supplied along the shaft supporting the bowl and is connected to the water jacket by a plurality of pipes extending from the shaft to the base of the jacket which extends only over the peripheral wall. The outlet for the discharge of the materials from the bowl is arranged as a plurality of openings at spaced positions around the hub connecting the shaft to the base of the bowl. This arrangement is completely impractical since the positioning of the openings will cause materials to be expelled from the base through those openings during normal processing without the materials passing over the separation area. Furthermore the connection of the feedwater through individual pipes is impractical due to the fact that the pipes are very vulnerable to damage and particularly to wear during the engagement of those pipes with the highly abrasive materials to be separated while the pipes are rotated about the axis at high velocity.

SUMMARY OF THE INVENTION

It is one object of the present invention therefore to provide a centrifuge apparatus of this general type including a bowl and a surrounding water jacket in which the discharge of collected materials, with the centrifugal action halted, can be effectively carried out through the base of the bowl.

According to the invention, therefore, there is provided an apparatus for centrifugally separating intermixed materials of different specific gravities comprising a centrifuge bowl having a base and a peripheral wall generally upstanding from the base to an open mouth and surrounding an axis passing through the base, a plurality of openings passing through the peripheral wall, a jacket having a sleeve portion surrounding at least part of the peripheral wall and a base portion underlying the base of the bowl so as to define a liquid receiving area between an outside surface of the bowl and the jacket for receiving liquid therein under pressure for passage through the openings into the bowl, means connecting the bowl and jacket for common rotation about the axis, a support member for the bowl and jacket for supporting and driving said bowl and jacket in said rotation, said support member including a shaft extending coaxially of said axis away from said base and means mounting the shaft for rotation about said axis, a feed duct extending through said open mouth separate from said shaft for feeding material to be separated into said bowl such that materials of higher specific gravity are collected by centrifugal action on the peripheral wall of the bowl while materials of lower specific gravity escape through the open mouth, supply means for supplying liquid into said liquid receiving area and discharge means for discharging, with said centrigual action halted, said collected materials from the bowl for collection, said supply means and discharge means each including duct portions extending through said support means.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
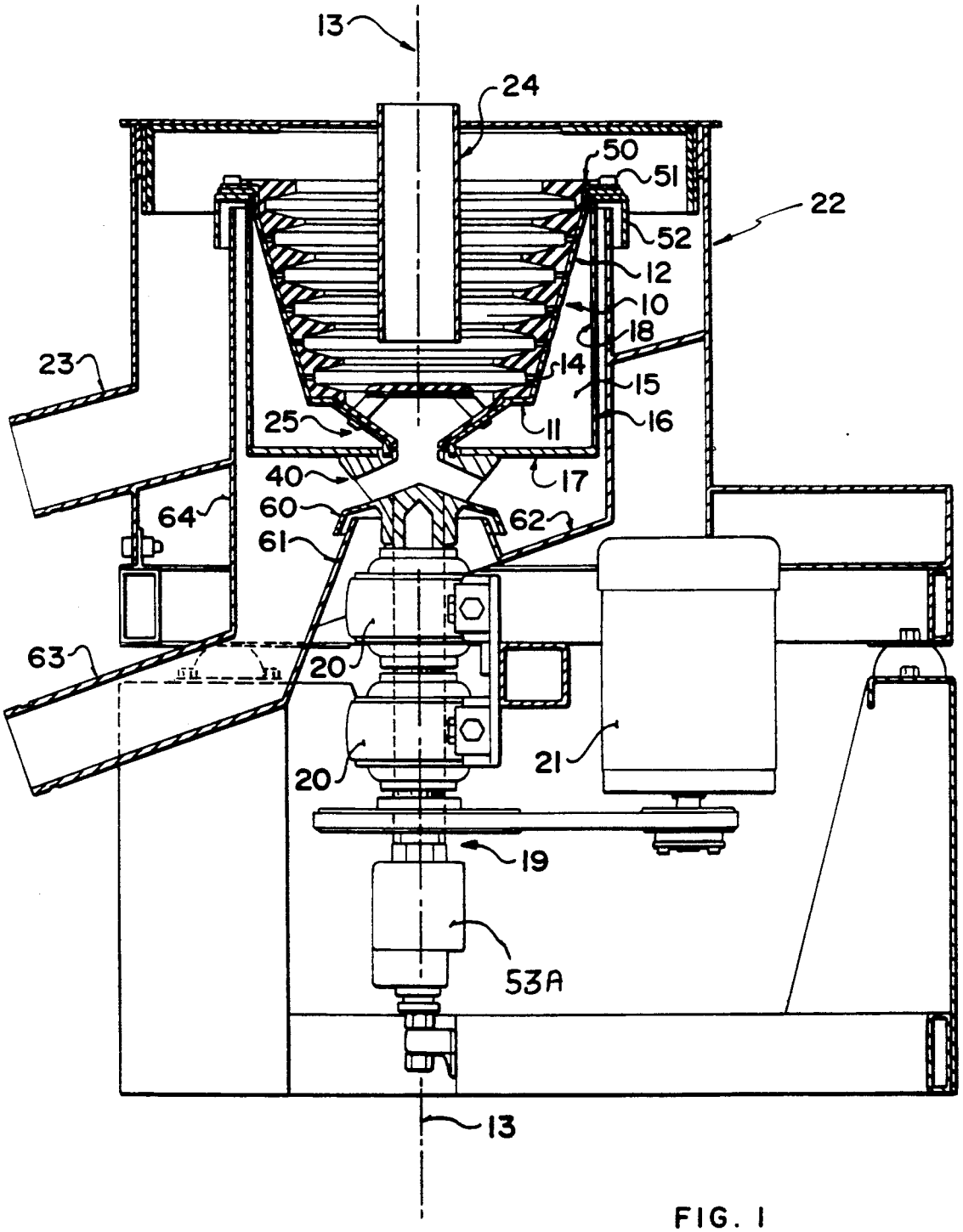
FIG. 1 is a vertical cross sectional view through a centrifugal separator according to the present invention.

The centrifuge apparatus is generally of the type shown for example in the above mentioned U.S. Pat. No. 4,846,781 of the present inventor. In general terms, therefore, the apparatus comprises a centrifuge bowl 10 having a base 11 and an upstanding side wall 12 for rotation about an axis 13. The peripheral wall has openings 14 through which water can be injected from the water receiving area 15 of a water jacket 16. The jacket includes a base portion 17 and a peripheral wall 18, the latter being cylindrical in shape and the former being a substantially flat disk welded at its peripheral edge to the base of the sleeve 16.

The bowl and the jacket are mounted for rotation about a shaft generally indicated at 19 which is mounted on bearings 20 for rotation about the axis 13. The shaft is driven by a motor 21 through a belt and pulley arrangement.

The bowl and the jacket are mounted within a housing 22 which defines a collecting launder 23 for material which escapes from the open mouth of the bowl after passage over the peripheral wall for separation. The material is fed into the bowl by a duct mounted on the housing 22 and extending along the axis 13 as a fixed supply duct 24 extending toward the base 11 of the bowl.

The above details are shown in the above previous patent of the present inventor together with a number of other previous patents of the inventor which describe various details of the machine.

Figure 2:
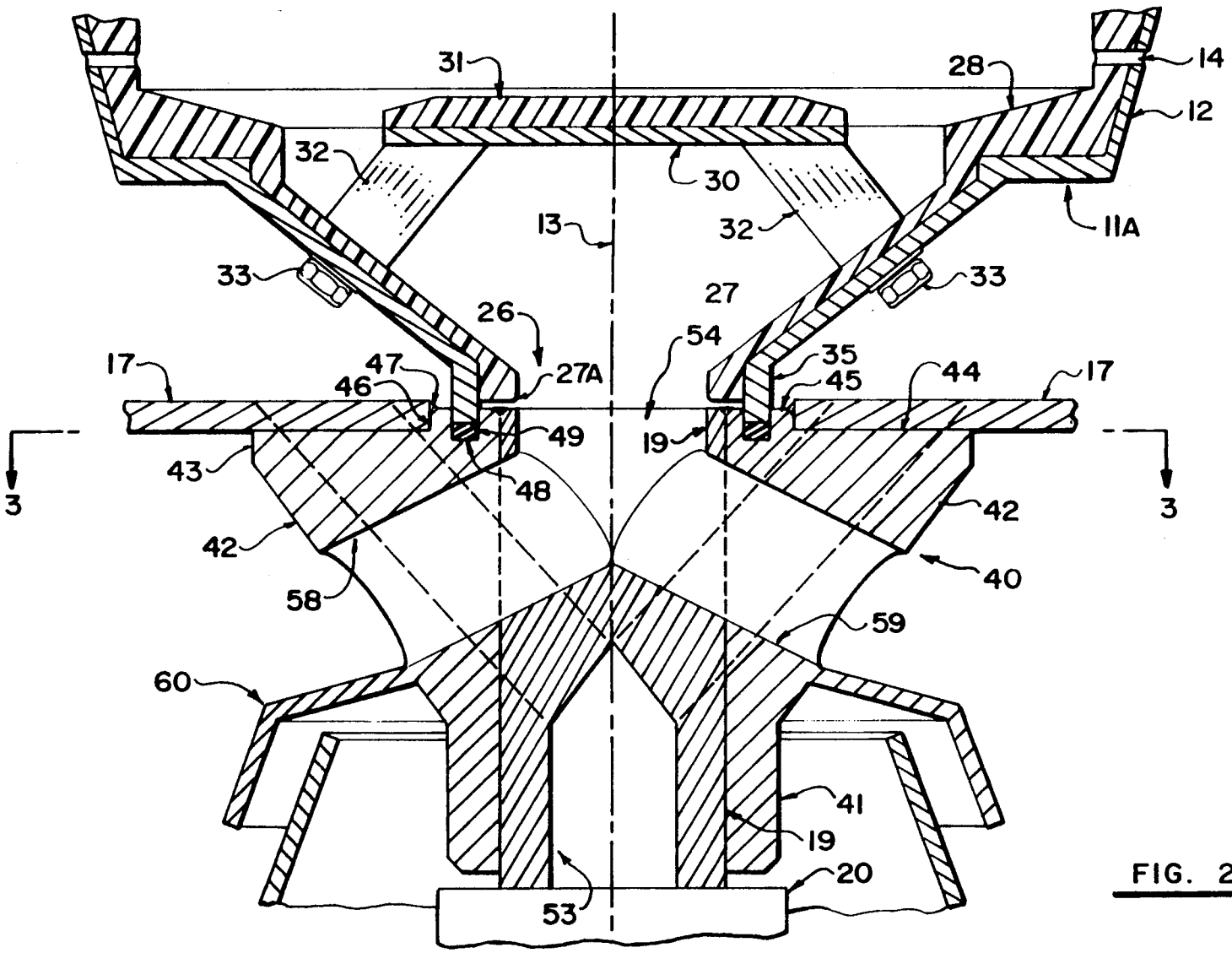
FIG. 2 is a cross sectional view of a part of the apparatus of FIG. 1 showing particularly the connection between the base of the bowl, the base portion of the outer jacket, the shaft and the support hub of the shaft.
Figure 3:
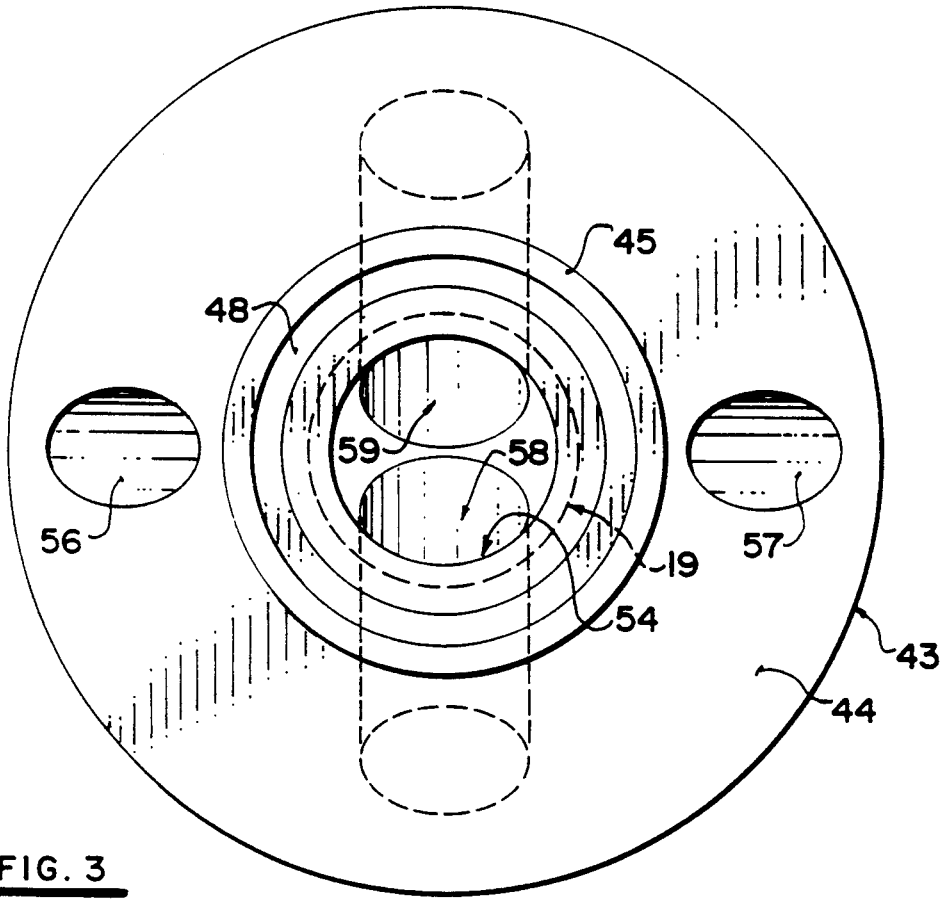
FIG. 3 is a view along the lines 3—3 of FIG. 2.
Figure 4:
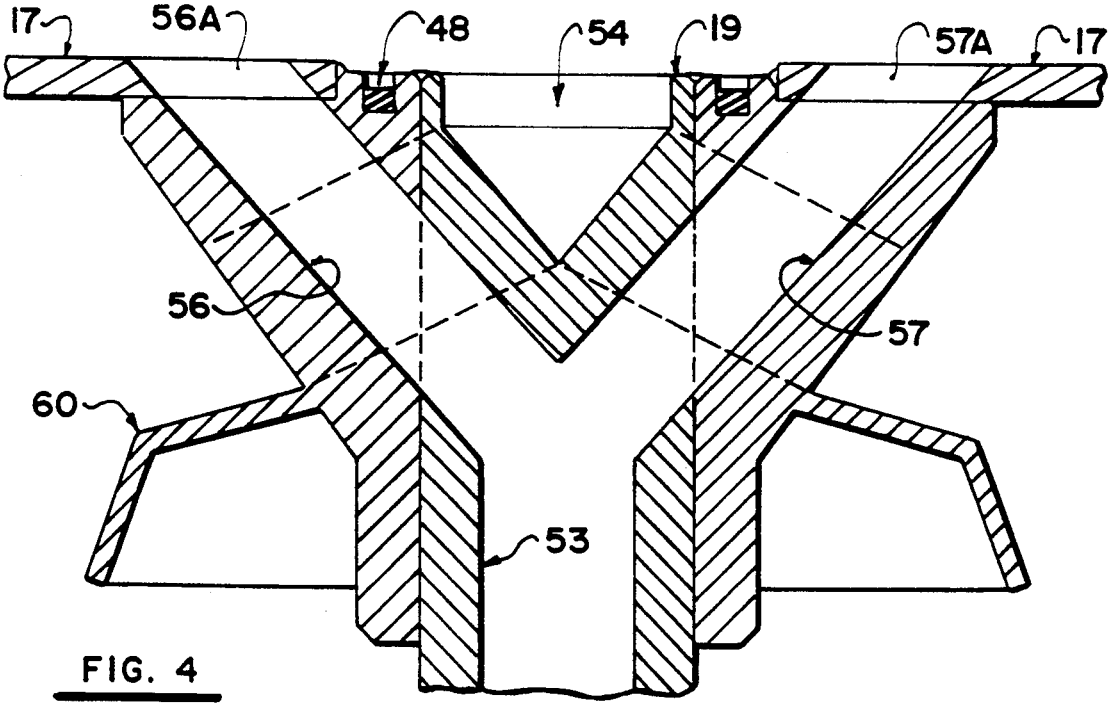
FIG. 4 is a cross sectional view of the support hub and shaft only of FIG. 2, the cross section being taken at right angles to the cross section of FIG. 2.

The details of the modification of the present invention are shown best in FIGS. 2, 3 and 4. In this arrangement, the base 11 of the bowl is, instead of the simple flat base of the prior art device, shaped to form a conical base section 25 which is welded to a narrow annular ring 11A forming an initial part of the base. The conical base portion converges inwardly and downwardly to a discharge opening 26 arranged coaxially with the axis 13. On top of the welded conical portion 25 is attached a liner of a suitable wear resistant plastics material 27. The liner extends from the lower most ring 28 of the bowl over the edge of the ring 11A and down across the conical portion to the discharge opening 26.

Above the plane of the ring 11A is mounted a base plate 30 which is simply a flat disc of circular plan view covered by a wear resistant layer 31 on the upper surface. The disc is mounted by a plurality of support elements 32 which extend from the underside of the plate outwardly and downwardly into engagement with the sides of the conical portion 25 to which the plate is attached by bolts 33. The outside periphery of the base plate 30 is less than the periphery of the lower most ring 28 so that there is an annular space between these elements which will allow material to fall downwardly under the action of gravity. The outside periphery of the base plate 30 is however significantly greater than the diameter of the discharge opening 26. In this way in normal centrifuging operation of the device, the feed material from the duct 24 is deposited onto the wear resistant layer 31 and from there moves outwardly toward the peripheral wall of the bowl. As the material moves outwardly it also accelerates to rotate at a speed approaching that of the angular velocity of the bowl so there becomes on the materials a relatively high centrifugal force up to the order of 25G. Under these centrifugal forces, the materials generally cannot fall vertically downwardly into the annular space between the base plate and the ring 28 but instead is flung outwardly into the ring 28 where an initial separation of the materials occurs following which the materials pass over the remaining rings of the bowl to be discharged from the open mouth. Any materials that do move downwardly into the area beneath the base plate engage the inwardly converging conical liner member 27 and thus are forced upwardly and outwardly relative to this liner due to the high centrifugal forces in this area. The materials certainly therefore cannot reach the discharge opening 26 during the normal processing.

At the bottom end of the conical portion 25 is welded a short cylindrical section 35 which is coaxial to the axis 13. This cylindrical section 35 projects outwardly just beyond a lower most edge 27A of the liner with the liner turning around and over the junction between the conical portion 25 and the cylindrical portion 35.

At the end of the shaft 19 is mounted a hub member 40 which is welded to the shaft and provides connection between the shaft and the bowl. The hub member includes a first cylindrical portion 41 and a second portion which is conical in shape and diverges outwardly from the first cylindrical portion 41 to a second cylindrical portion 43. The conical portion indicated at 42 thus increases in diameter from the portion 41 just surrounding the shaft to the larger diameter of the portion 43 which provides an upper plate 44 which is generally flat for engaging against the bottom surface of the base portion 17 of the jacket. The hub member is generally a solid body to provide structural strength for connection of the shaft to the base portion or plate 17 to hold the bowl and jacket in the cantilever arrangement during rotation at the high velocity necessary to provide the centrifugal forces required for proper separation.

The upper plate 44 of the hub member includes a raised ring 45 adjacent an inner part of the upper plate of diameter just greater than that of the shaft 19. The raised ring 45 provides a shoulder for receiving an opening 46 in the base plate 17 of the jacket. The shoulder is welded to the inner edge of the opening as indicated at 47 to connect the base plate and the hub member. An annular recess 48 is provided in the raised portion 45 with a bead of a sealing material 49 provided in the recess for engaging against the end face of the cylindrical portions 35 of the bowl. The bowl is thus formed as a separate element which is attached to the outer jacket by insertion of the bowl into the outer jacket, the location of the cylindrical portion 35 into the recess 48, and the clamping of an upper flange 50 of the bowl by bolts 51 to a cooperating flange 52 of the jacket.

The hub member 40 is arranged and machined to provide communication of discharge materials out through the opening 26 into the shaft and at the same time the supply of feed water from the shaft 19 into the interior of the jacket.

Thus the shaft 19 includes a central hollow duct 53 through which the water is supplied from a connection 53A at the lower end of the shaft. The water thus flows along the hollow interior of the shaft 19 from the bottom upwardly toward the jacket.

The shaft 19 at its upper end cooperates with the opening 26 and has a diameter substantially equal to the opening 26 so the materials flowing out of the bowl, when the centrifugal action is halted, escape into the shaft 19 at its hollow upper portion indicated at 54.

The hollow upper portion 54 of the shaft 53 communicates with the interior of the jacket through a pair of drilled holes 56 and 57 best shown in FIG. 4. These drilled holes are drilled through the plate 17 as indicated at drilled portions 56A and 57A and through the hub member to intersect with the hollow interior 53 of the shaft.

The drilled holes 56 and 57 thus extend from the hollow interior of the shaft 53 and diverge upwardly and outwardly at diametrically opposed locations so as to bypass and be physically disconnected from the hollow upper portion 54 of the shaft at the upper part of the shaft.

Symmetrically but in opposite direction, the hollow upper portion 54 of the shaft is connected to a pair of ducts 58 and 59 which are drilled through the hub member from the conical surface 42 in a direction inclined inwardly and upwardly toward the axis 13 so as to break out in the hollow upper portion 54. As best shown in FIG. 3, the ducts 58 and 59 are arranged in diametrically opposed position and arranged at 90° relative to the ducts 56 and 57 so that there is no interconnection between the ducts and there is sufficient material remaining in the hub member to provide the required structural strength for the hub member.

The holes 56 and 57 are drilled of sufficient diameter to allow communication of the required amount of water from the interior 53 of the shaft into the interior of the jacket for supply of fluidization water into the bowl.

Similarly the ducts 58 and 59 are of sufficient diameter to exceed in total area the area of the outlet 26 so that material washed through the outlet 26 can be carried away through the ducts 58 and 59 to escape from the outside surface of the hub member.

For collection of the discharged materials, there is provided a generally dome shaped cap 60 which sits over the bearing 20 and is attached to the hub member for rotation therewith. The dome shape cap 60 covers an inner launder surface 61 which extends downwardly and outwardly from the underside of the cap. The bottom of the conical launder wall 61 communicates toward an inclined launder base plate 62 which extends downwardly toward one side of the housing 22 to a discharge duct 63. An inner wall 64 of the outer launder for the main discharge materials separates the inner launder for the collected materials from the outer launder for the discharged materials or gangue.

In operation, the machine is operated in batch mode so that it is operated for a selected period of time to process a particular predetermined quantity of materials. The materials are separated in the conventional manner with the feed material entering the bowl, being thrown outwardly onto the wall of the bowl, being separated across the wall of the bowl with the gangue being discharged to the open mouth to the launder and the heavier materials being collected on the wall. When the processing is complete, that is the maximum amount of material has been processed for efficient separation, the material feed through the duct 24 is halted and the liquid washing feed is reduced in pressure thus reducing the volume flowing through the openings into the bowl.

The bowl is then halted by disconnecting the drive from the motor and optionally the application of a brake. When the bowl is halted, the supply of water from the shaft interior 53 through the ducts 56 and 57 is restarted under normal pressure thus providing a vigorous washing action in the grooves which propels the collected materials out of the grooves to fall to the bottom of the bowl. This material is then washed downwardly in the bowl and passes through the annular space between the base plate and the conical section of the bowl and thus is washed through the conical section and into the discharge opening 26. The escaping materials thus pass through the ducts 58 and 59 to the outside surface of the hub member at a position spaced from the interior 53 of the shaft so that they can be released into the inner launder for collection through the discharge duct 63.

The washing action takes place efficiently in view of the central discharge opening of the bowl. The special design of the hub member provides communication of the discharge materials from the base of the bowl, the supply of feed water into the interior of the jacket and the structural strength to support the bowl during its high velocity rotation.

Figure 5:
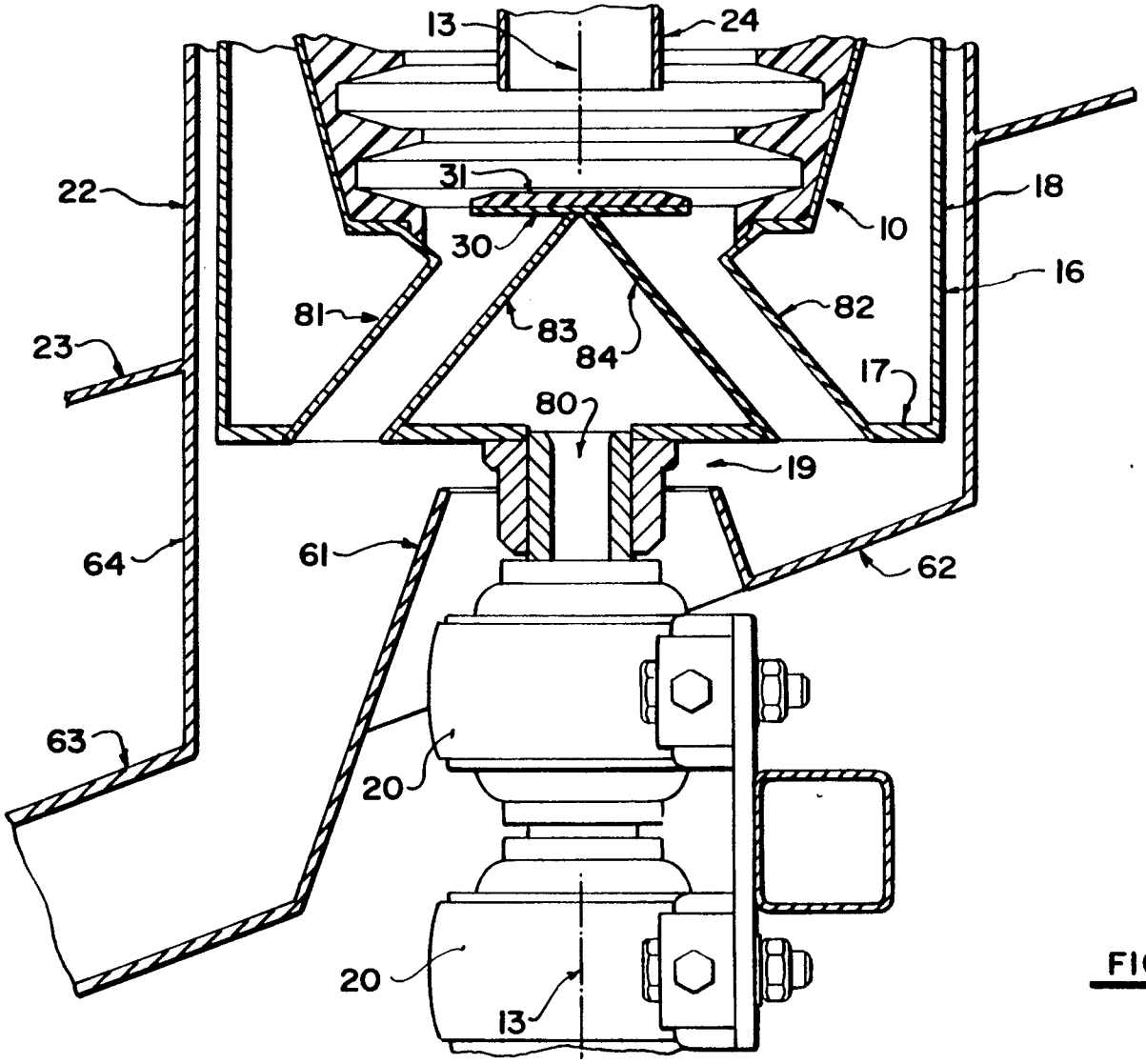
FIG. 5 is a cross-sectional view similar to that of FIGS. 1 and 2 showing an alternative arrangement of discharge arrangement for the bowl.

In FIG. 5 is shown an alternative arrangement in which the discharge arrangement for the bowl is modified relative to that shown in FIG. 2. The remaining elements are effectively the same as the previous embodiment except that the support member 19 for the bowl is of the conventional type used on previous designs of the machine manufactured by the present inventor and shown in his previous patents in which the water for supply to the jacket for feeding through the openings in the bowl is passed through the shaft and emerges from a feed opening 80 through the base portion of a jacket into the area between the base of the bowl and the base portion of the jacket.

In this case the discharge from the base of the bowl passes through ducts which extend from the base of the bowl through the space between the base of the bowl and the jacket, through the base portion of the jacket and into the area underneath the base portion of the jacket. The ducts are indicated at 81 and 82 and these diverge outwardly from the underside of the bowl and particularly from the underside of the plate 30 previously described. The ducts 81 and 82 extend from a pair of recesses 83 and 84 attached to the underside of the bowl so that the material discharged from the bowl runs to the bottom of the bowl and enters the two recesses at 83 and 84 for discharge along the ducts 81 and 82.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. Apparatus for centrifugally separating intermixed materials of different specific gravities comprising:

a centrifuge bowl having an open mouth, a base and a peripheral wall generally upstanding from the base to said open mouth, said peripheral wall surrounding a vertical axis passing through the base, a plurality of openings passing through the peripheral wall;

a jacket having a base plate and a sleeve portion surrounding the peripheral wall of the bowl so as to define a sleeve-shaped channel therebetween, the base plate underlying the base of the bowl and being spaced therefrom so as to define between the base and the base plate a liquid receiving area, the base plate being connected to a lowermost edge of the sleeve portion;

means connecting the bowl and jacket for common rotation about the axis;

a support member for the bowl and jacket for supporting and driving said bowl and jacket in said rotation, said support member including a shaft extending coaxially of said axis away from said base plate, a hub member connected to said shaft and means mounting the shaft for rotation about said axis, feed means including a stationary feed duct extending through said open mouth separate from said shaft for feeding materials to be separated into said bowl, said feed means being arranged such that the materials pass from the feed duct onto the peripheral wall for materials of higher specific gravity to be collected by centrifugal action on the peripheral wall of the bowl while materials of lower specific gravity escape through the open mouth; supply means including a hollow interior of the shaft for supplying fluidizing liquid through the base plate of the jacket into the liquid receiving area between the base plate and the base of the bowl for passage through the sleeve shaped channel and the openings into the bowl; and discharge means for discharging, with said centrifugal action halted such that the collected materials are washed down from the peripheral wall to the base, said collected materials from the bowl;

wherein said supply means includes at least one supply duct portion extending through said hub member and said discharge means includes at least one discharge duct portion extending through said hub member with said at least one supply duct portion being angularly offset from said at least one discharge duct portion.

2. The apparatus according to claim 1 wherein the hub member is attached to an underside of the base plate of the jacket.

3. The apparatus according to claim 1 wherein the discharge means includes a discharge area of the base of the bowl which converges downwardly and inwardly toward said axis to define a single discharge opening coaxial of said axis and wherein said at least one discharge duct portion extends through the hub member and extends outwardly from the axis and downwardly from the single discharge opening to exit from the hub member at a position thereon spaced from said axis and wherein said at least one supply duct portion extends from the hollow interior of the shaft upwardly and outwardly from the axis through the hub member so as to extend from the hub member through the base plate of the jacket to supply said liquid into said liquid receiving area.

4. The apparatus according to claim 3 wherein the bowl includes a base member positioned above said discharge area of the base and providing an opening around the base member.

* * * * *